US005167557A

United States Patent [19]

Teramoto et al.

[11] Patent Number: 5,167,557

[45] Date of Patent: Dec. 1, 1992

[54] METHOD FOR MANUFACTURING A SHADOW MASK

[75] Inventors: Hiroyuki Teramoto; Kimio Hashizume, both of Amagasaki; Tetsuya Watanabe; Hideya Ito, both of Nagaokakyo, all of Japan

[73] Assignee: Mitsubishi Denki Kabushiki Kaisha, Tokyo, Japan

[21] Appl. No.: 638,818

[22] Filed: Jan. 8, 1991

[30] Foreign Application Priority Data

Jan. 9, 1990 [JP] Japan ..... 2-2845

[51] Int. Cl.[5] ..... H01J 9/20; C21D 6/00; C21D 6/02

[52] U.S. Cl. ..... 445/47; 445/37; 148/230; 148/222

[58] Field of Search ..... 445/47, 37, 58; 148/14, 148/16.6, 230, 208, 222

[56] References Cited

U.S. PATENT DOCUMENTS 1,930,388 10/1933 Hatfield ..... 148/16.6
1,950,549 3/1934 Fry et al. ..... 148/14
4,306,172 12/1981 Matsukura et al. ..... 313/402
4,612,061 9/1986 Suzuki et al. ..... 148/14

FOREIGN PATENT DOCUMENTS 0125931 11/1984 European Pat. Off. ..... 445/37
2945467 5/1980 Fed. Rep. of Germany .
25446 12/1967 Japan .
58977 5/1975 Japan .
68650 6/1975 Japan .

OTHER PUBLICATIONS

JP-55-125267 (A) English Abstract (Sep. 1980).

*Primary Examiner*—Richard K. Seidel
*Assistant Examiner*—Jeffrey T. Knapp

[57] ABSTRACT

A method for manufacturing a shadow mask is used for color television picture tubes and the like. The surface of a shadow mask body, made of Fe-Ni type alloy, is ion-nitriding processed so as to make the most of the low thermal expansion property inherent in the alloy. The result is that the color purity degradation caused by the thermal expansion at temperature increases of the mask, and by the resonance of the mask itself, can be prevented, thereby realizing a shadow mask serving to render a highly refined CRT.

6 Claims, 2 Drawing Sheets

METHOD FOR MANUFACTURING A SHADOW MASK

BACKGROUND OF THE INVENTION

1. Field of the Invention

This invention relates to a method for manufacturing a shadow mask which is used in, for example, color a television picture tube.

2. Description of the Related Art

FIG. 1 of the accompanying drawings is a sectional view showing primary portions of a color television picture tube. Electronic beams 1, 2 and 3, corresponding to the red, green, and blue colors respectively, and emitted from an electronic gun, pass through a number of fine apertures 5 which are regularly arranged color selection electrodes of the shadow mask 4. Thereafter, the electronic beams 1, 2, and 3 correctly collide against the corresponding fluorescent materials 6, 7 and 8, which render luminous phenomenon of red, green and blue colors respectively, of a fluorescent screen 9 formed at the inner surface of a panel 10, so as to present color images.

As a material of the shadow mask 4 in such a color picture tube, a low carbon Al killed steel, containing high purity Fe as a main component, has been generally used heretofore. This selection is made by integrally taking the machinability, strength, cost and the like into consideration.

Despite having excellent machinability, such a conventional shadow mask 4 for color picture tube has been disadvantageous in that its color purity tends to degrade due to the phenomenon called doming; in operation of a color picture tube, generally only $\frac{1}{3}$ of the total electronic beam pass through the aperture 5 of the shadow mask 4. The residuals collide against the shadow mask 4 itself, not against the fluorescent screen, thereby causing the shadow mask 4 to be heated over 80° C. As a result, the shadow mask 4 becomes thermally expanded and stressed, impeding the electronic beams from correctly colliding against the fluorescent screen. Thus, the color purity degrades. The thermal expansion coefficient of the Al killed steel, used as the raw material for the shadow mask, is large, being $1.2 * 10^{-5}$/deg at 0°–100° C. This has been a serious problem in shadow masks which are to be evolved toward higher refinement.

To cope with the problem mentioned above, a shadow mask made of e.g. Fe-Ni type invar alloy (Fe-Ni 36%) having smaller thermal expansion coefficient than in Al killed steel has been conventionally used, as described for example in Japanese Patent Laid-Open No. 25446/1967, 58977/1975, or 68650/1975.

However, the shadow mask made of invar alloy is inferior in aseismatic property to a shadow mask made of Al killed steel. This inferiority is mainly attributable to the lowering of Young's modulus of the shadow mask itself, caused by raw material properties and the high temperature annealing process executed to improve the shadow mask's formability.

Namely, in addition to the original lowness in Young's modulus of invar alloy being 1400 kgf/mm$^2$ in comparison with that of the conventional Al killed steel being 20000 kgf/mm$^2$, the high temperature annealing for improving the formability of the shadow mask acts to make its crystal grain bulky, thereby further lowering the Young's modulus.

This lowering of the Young's modulus reduces the resonance frequency and causes so-called howling, a phenomenon that the shadow mask itself resonates and trembles by external vibrations of sounds from the speaker etc. when incorporated into the color picture tube. Consequently, there would arise a positional divergence between the aperture of the shadow mask and the electronic beam, so as to degrade the color purity. This has been a serious obstacle to put the shadow mask to practical use, meeting the recent strong requirement of higher refinement.

SUMMARY OF THE INVENTION

It is therefore an object of this invention to provide a method for manufacturing a shadow mask which can prevent the shadow mask from color purity degradation, caused by thermal expansion at the time of temperature increase and by the resonation of the shadow mask itself upon applied external vibrations.

According to this invention, a method for manufacturing a shadow mask comprising the steps of: annealing, at a predetermined high temperature, a shadow mask body which is composed by forming a number of apertures in a metallic plate made of Fe-Ni type alloy; press-molding the annealed shadow mask body; ion-nitriding the surface of press-molded shadow mask body; performing a blackening process on the ion-nitrided shadow mask body.

In this invention, the use of Fe-Ni type alloy having low thermal expansion property as a raw material for the shadow mask acts to make the most of the low thermal expansion property inherent in the alloy, thereby preventing any color purity degradation caused by thermal expansion at the temperature increase. Further, the ion-nitriding processed on the surface of the Fe-Ni type alloy enhances the Young's modulus, thereby also preventing the mask from color purity degradation caused by resonance of the mask itself, upon applied external vibrations like of speaker sound.

The above and other advantages, features and additional objects of this invention will be manifest to those versed in the art upon making references to the following detailed description and the accompanying drawings in which a preferred structural embodiment incorporating the principles of this invention is shown by way of illustrative example.

DETAILED DESCRIPTION

Figure 1:
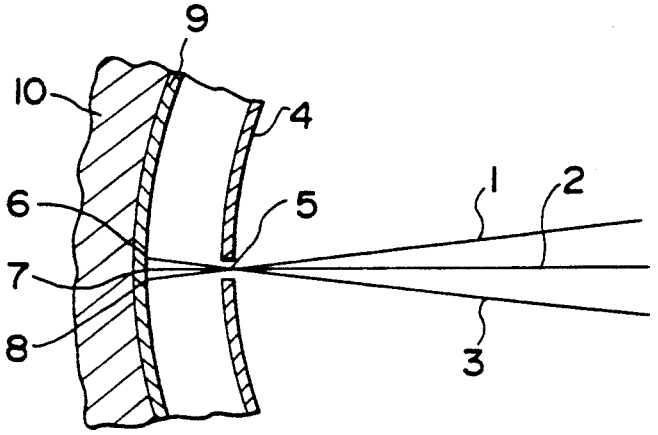
FIG. 1 is a sectional view showing a principal part of a general color picture tube.

A sectional view of a shadow mask completed according to this invention is basically similar to that of the conventional mask shown in FIG. 1. Therefore, the present method will now be explained, referring also FIG. 1 wherein the numerals designate the equal or similar components to the conventional one.

A method for manufacturing this shadow mask will be now explained. A shadow mask body is constituted by a metallic plate, made of Fe-Ni type alloy containing Fe and Ni as primary components and having a number of apertures formed thereon. The shadow mask body is annealed at a high temperature, and press-molded. Then, ion-nitriding process and a convention blackening process are subsequently applied on its surface.

Here, a standard ion-nitriding process will be mentioned. In a low-pressure nitrogen atmosphere, applying d.c. voltage between a furnace body and a subject material generates glow discharge. At this time, the nitrogen in the furnace ionizes to emit electrons, resulting in nitrogen ions which migrate toward, and collide against, the subject material forming the negative electrode. In consequence, some of the nitrogen ions directly implant themselves into the subject material, while some of them act to extract electrons and Fe, C, O, etc. from the surface thereof. Thus extracted Fe atoms come to be combined with atom-like nitrogen in the plasma produced by the glow discharge, so as to compose nitrided iron (Fe-N) which is adsorbed on the surface of the subject material.

Owing to the temperature increase and ion collision on the surface of the subject material, the nitriding iron (Fe-N) subsequently decomposes into the nitrides of lower order. Further, a part of the nitrogen enters and diffuses to the internal portions of the subject material, thereby making the surface of the subject raw material harder and the Young's modulus enhanced. In particular, this enhanced Young's modulus improves the rigidity of the shadow mask and significantly reduces the howling caused by external vibrations such as speaker sounds.

Such a conventional nitriding method, however, has been disadvantageous in that the compound formed on the surface of the subject material was usually brittle, and that not a little skill was required to control the thickness of such surface layer. In contrast, according to the ion-nitriding process adopted in this invention, the state of the surface layer can be controlled with high reproducibility, by regulating several factors during the process.

The raw material used in this embodiment is a metallic plate of Fe-36%Ni (invar alloy) with 0.15 mm of thickness, having the ingredients shown in the TABLE 1. In order to study the property of the raw material, firstly, it was annealed at 1150° C. under the vacuum atmosphere. Thereafter, the ion-nitriding process was carried out in the six kinds of temperature conditions: 380° C., 420° C., 450° C., 480° C., 580° C. and 600° C., each under the atmosphere of; one hour of retention time, processing pressure of 4.0 torr, N2:H2 ratio of 1:1. Furthers the hardness and the Young's modulus of the processed subject material, along with those of non-ion-nitriding processed one as a comparative material, were examined. The result is show in TABLE 2.

It is understood from this TABLE 2, that the ion-nitriding process effects to enhance both the hardness and the Young's modulus at any temperature. Above all, the material processed at 420° C. has the hardness 2.5 times larger and the Young's modulus approximately 20% larger than the non-ion-nitriding processed material.

Next, the subject material is: served to form a number of apertures thereon by photo-etching; annealed at 1150° C. in the vacuum atmosphere; and then press-molded, thereby examined its properties as a shadow mask. Also, the ion-nitriding process was applied under the same conditions as the aforementioned case of raw material at the several different temperatures.

TABLE 3 shows the ratio of the migrated electronic beams caused by howling and the damping time of the vibrations with non-processed material as 100%, of the shadow mask to which the blackening process in steam atmosphere or DX gas atmosphere at 600° C. is applied, and incorporated into an actual color picture tube, after estimating the deforming degree of the shadow mask upon completion of the ion-nitriding process.

Figure 2:
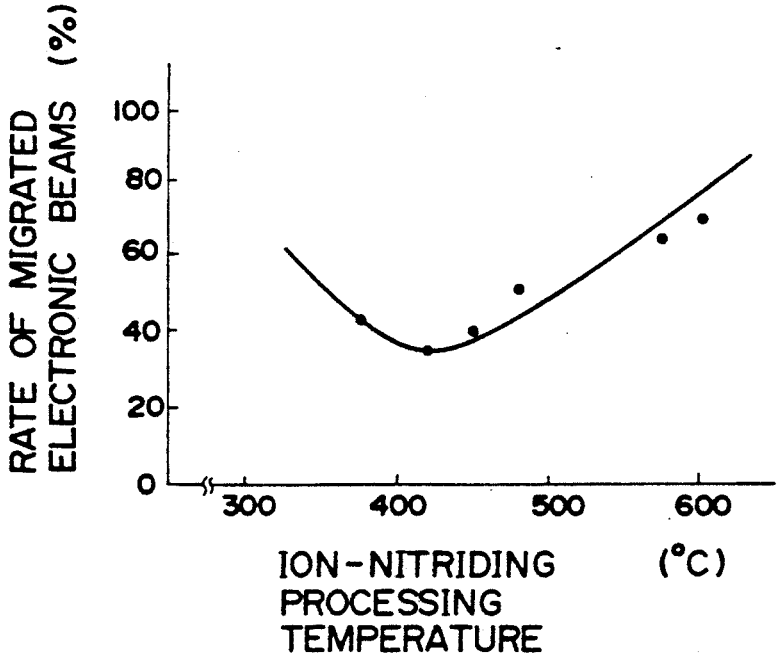
FIG. 2 is a graphic diagram showing the mobility rate of electron beams corresponding to the ion-nitriding process temperature (°C.) when assumed a non-ion-nitrided material as 100%, according to an embodiment of this invention.
Figure 3:
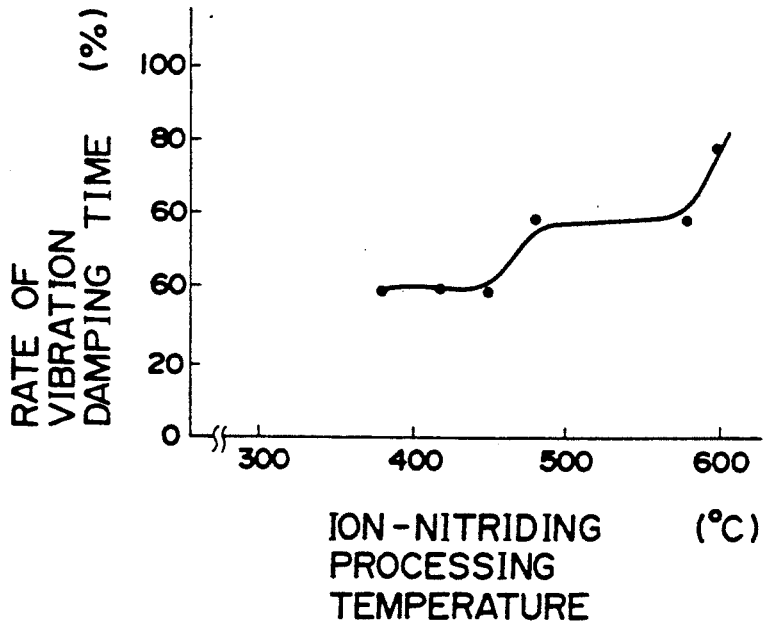
FIG. 3 is a graphic diagram showing the vibration damping time rate corresponding to the ion-nitriding process temperature (°C.) when assumed a non-ion-nitrided material as 100%, according to an embodiment of this invention.

FIG. 2 shows the relationship between the ion-nitriding processing temperature (°C.) and the ratio of migrated electronic beams (%). FIG. 3 likewise shows the relationship between the ion-nitriding processing temperature (°C.) and the ratio of vibration damping time (%).

As seen from TABLE 3, slight deformation was caused in the shadow masks which were ion-nitriding processed at higher temperatures. Meanwhile, there were substantially the same tendencies, as in the case of raw material, on the ratio of migrated electronic beams and of the ratio of vibration damping time. The minimums on both these ratios were found in the shadow mask processed at 420° C., showing the undersirable influence of howling notably reduced.

According to this embodiment, the surface of the shadow mask molded from Fe-Ni type alloy as a raw material is ion-nitrided to enhance its rigidity and to make the most of the low thermal expansion property inherent in the alloy used as a raw material. In consequence, the shadow mask becomes reduced in thermal expansion property, thereby realizing a color picture tube with minimum color purity degradation caused by the thermal expansion at the increased temperature or by the external vibrations like of speaker sound.

Further, while other coating methods like plating or vapor deposition may cause problems depending on the types of coating at the steps of etching or the blackening process, according to the present embodiment, the subject material can be etched or blackening-processed without any problem, just as the raw material, because its surface is not coated by any other materials.

In the shown embodiment, the optimum effect has been obtained at 420° C. However the processing temperature should be selected depending on the retention time, processing pressure, processing atmosphere or melanism-processing temperature. According to the experiment, shadow masks of excellent properties can be manufactured by selecting the ion-nitriding processing temperature within the range of 350°-500° C.

Besides the invar alloy, other Fe-Ni type alloys can be also used as a material for the shadow mask according to this invention.

TABLE 1

| | ELEMENTS | | | | | | |
|---|---|---|---|---|---|---|---|
| | C | Mn | Si | P | S | Ni | Fe |
| wt % | 0.008 | 0.40 | 0.15 | 0.005 | 0.002 | 36.2 | residuals |

TABLE 2

| | PROCESSING TEMPERATURE (°C.) | HARDNESS (MHv) | YOUNG'S MODULUS (kg/cm$^2$) |
|---|---|---|---|
| ION-NITRIDING | 380 | 497 | 14500 |
| | 420 | 508 | 14600 |
| | 450 | 433 | 14100 |

TABLE 2-continued

| | PROCESSING TEMPERATURE (°C.) | HARDNESS (MHv) | YOUNG'S MODULUS (kg/cm²) |
|---|---|---|---|
| | 480 | 358 | 14000 |
| | 580 | 325 | 13400 |
| | 600 | 320 | 13200 |
| NON-ION NITRIDING | — | 197 | 12200 |

TABLE 3

| | PROCESSING TEMPER-ATURE (°C.) | SHADOW MASK DEFORMED RATE | MIGRATED ELECTRONIC BEAM RATE (%) | VIBRATION DAMPING TIME RATE (%) |
|---|---|---|---|---|
| ION-NITRIDING | 380 | * | 45 | 40 |
| | 420 | * | 35 | 40 |
| | 450 | * | 42 | 40 |
| | 480 | * | 52 | 60 |
| | 580 | X | 65 | 60 |
| | 600 | X | 72 | 80 |
| NON-ION-NITRIDING | — | * | 100 | 100 |

[*: SUBSTANTIALLY NO DEFORMATION, X: SLIGHT DEFORMATION]

As described above, according to this invention, the surface of a shadow mask made by Fe-Ni alloy containing Fe and Ni as primary components is ion-nitrided. In consequence, the color purity degradation caused by thermal extension, and by the resonance of the mask itself, can be prevented, thereby realizing an excellent shadow mask for a highly refined CRT.

From the above-described embodiment of the present invention, it is apparent that the present invention may be modified as would occur to one of ordinary skill in the art without departing from the spirit and scope of the present invention which should be defined solely by the appended claims. Changes and modifications of the system contemplated by the present preferred embodiments will be apparent to one of ordinary skill in the art.

What is claimed is:

1. A method for manufacturing a shadow mask, comprising the steps of:

(a) annealing, at a predetermined temperature, a shadow mask body which is composed by forming a number of apertures in a metallic plate made of Fe-Ni type alloy;

(b) press-molding the annealed shadow mask body;

(c) ion-nitriding a surface of the press-molded shadow mask body; and (d) performing a blackening process on the ion-nitrided shadow mask body, wherein said ion-nitriding step is carried out at a temperature predetermined based upon at least one of retention time, processing pressure, processing atmosphere, and melanism-processing temperature.

2. The method for manufacturing a shadow mask of claim 1, wherein the metallic plate is made of one of Fe-Ni(36%) alloy and an invar alloy, and has a thickness of less than 0.15 mm.

3. The method for manufacturing a shadow mask of claim 1, wherein said annealing step is carried out at a predetermined temperature of approximately 1150° C. in vacuum atmosphere.

4. The method for manufacturing a shadow mask of claim 1, wherein said step of performing a blackening process is carried out at a temperature of approximately 600° C. in one of steam atmosphere and gas atmosphere.

5. The method for manufacturing a shadow mask of claim 1, wherein said ion-nitriding step is carried out at a temperature of approximately 420° C.

6. The method for manufacturing a shadow mask of claim 1, wherein said ion-nitriding step is carried out at a predetermined temperature within a range of 350° C.-500° C.

* * * * *